United States Patent [19]

Bonnici et al.

[11] Patent Number: 4,476,047

[45] Date of Patent: Oct. 9, 1984

[54] PROCESS FOR TREATMENT OF OXIDE FILMS PRIOR TO CHEMICAL CLEANING

[75] Inventors: Paul J. Bonnici, St. Catherines; Robert P. Denault, Niagara Falls, both of Canada

[73] Assignee: London Nuclear Limited, Ontario, Canada

[21] Appl. No.: 360,149

[22] Filed: Mar. 22, 1982

[51] Int. Cl.[3] ..... G21F 9/00

[52] U.S. Cl. ..... 252/626; 134/2; 134/3; 134/28; 376/306

[58] Field of Search ..... 252/626, 627; 134/2, 134/3, 28; 376/306

[56] References Cited

U.S. PATENT DOCUMENTS

| | | | |
|---|---|---|---|
| 2,850,415 | 9/1958 | Harrison | 148/6.14 R |
| 3,311,565 | 3/1967 | Michael . | |
| 3,496,017 | 2/1970 | Weed . | |
| 3,664,870 | 5/1972 | Oberhofer et al. . | |
| 3,737,373 | 6/1973 | Motojima et al. . | |
| 3,873,362 | 3/1975 | Mihram et al. | 134/3 |
| 4,042,455 | 8/1977 | Brown . | |

FOREIGN PATENT DOCUMENTS

| | | |
|---|---|---|
| 434510 | of 0000 | Canada . |
| 748810 | 12/1966 | Canada . |
| 823621 | 9/1969 | Canada . |
| 873301 | 6/1971 | Canada . |
| 882649 | 10/1971 | Canada . |
| 891448 | 1/1972 | Canada . |
| 929449 | 7/1973 | Canada . |
| 968075 | 5/1975 | Canada . |
| 1062590 | 9/1979 | Canada . |
| 1117852 | 2/1982 | Canada . |
| 2454159 | 7/1980 | France . |

OTHER PUBLICATIONS

Vincente-Perez et al., "Analytical Chemistry of Uncommon Valences", Chem. Abstracts 87, (1977): 61935b.

*Primary Examiner*—Deborah L. Kyle

*Attorney, Agent, or Firm*—Beveridge, DeGrandi & Kline

[57] ABSTRACT

A process is described for oxidizing pretreatment of chromium (III) oxide containing films, resulting from corrosion of base metal surfaces of piping systems and the like, to render the corrosion films more amenable to conventional chemical cleaning treatments. The process uses a dilute aqueous solution of an iron (VI) salt ($FeO_4^{2-}$).

30 Claims, No Drawings

PROCESS FOR TREATMENT OF OXIDE FILMS PRIOR TO CHEMICAL CLEANING

The invention described herein relates to a method of oxidation of chromium (III)-containing films, layers or deposits of corrosion products formed on internal surfaces of chromium-containing steel piping systems, such as nuclear reactor heat transfer systems and the like, with a dilute solution of an iron (VI) salt so as to render the chromium compounds in the corrosion films susceptible to the action of conventional cleaning and decontaminating agents.

During the operation of a nuclear reactor, the high-temperature, high-pressure water coolant corrodes the wetted surfaces of piping, valves, heat exchangers, and core components. The transport of dissolved and particulate materials into and out of the reactor core, where they are bombarded by neutrons, produces radioactive isotopes of certain metals, notably iron-59, cobalt-58, cobalt-60, chromium-51, and manganese-54. These, together with radioactive fission products and uranium oxides resulting from fuel defects, become incorporated into the growing oxide film. Thus the radioactive isotopes become distributed throughout the coolant pipe surfaces.

The accumulation of radionuclides on pipe internal surfaces leads to radiation doses to personnel working in the vicinity, as well as increased risks from airborne contamination where cutting or grinding are required. If and when decontamination of the piping is required, usually for repairs or maintenance, it is necessary to remove nearly all the corrosion products with their associated radionuclides to obtain an acceptable decontamination factor. The decontamination factor is defined as the ratio of activity before decontamination to activity after decontamination.

There have been several investigations into the composition and structures of the oxide films found on the internal surfaces of reactor piping. The nature of the deposits will depend on the composition of the piping and the chemistry of the water coolant.

In light water cooled pressurized water reactors (PWR) the total internal surface area is usually made up of approximately 10 to 20% of piping constructed of stainless steel type 304. Zircaloy (Trademark) fuel cladding and Inconel 600 (Trademark) steam generator tubing may make up about equal parts of the balance of the internal surface area.

The chemistry conditions maintained during operation in a PWR are usually reducing. As the base metal corrodes, metallic ions are released to the coolant and subsequently are redeposited on the surfaces to form oxides. Typical PWR corrosion films generally contain magnetite, nickel ferrites and iron chromites ($FeOCr_2O_3$). The amount of chromium in the film is generally 30 to 40% by weight. Oxides of this type containing chromium are very insoluble. The effectiveness of decontamination solutions is severely limited, if a chromium-rich film is present. In order to solubilize the chromium-rich film, oxidation of the substantially insoluble chromium (III) to the more soluble chromium (VI) is required. This is achieved by treatment of the oxide layer in the reactor piping with a strong oxidizing agent prior to the use of conventional cleaning agents.

In boiling water reactors (BWRs), about half of the total internal surface area is generally made up of primary piping constructed of stainless steel type 304 and the other half is made up of Zircaloy fuel cladding. Most BWRs operate with a slightly oxidizing coolant (up to 200 ppb oxygen). Typical BWR corrosion films generally contain principally hematite ($Fe_2O_3$), some magnetite ($Fe_3O_4$), and some nickel ferrites ($NiOFe_2O_3$), but very little chromium containing oxides. Chromium from the base metal is mostly oxidized to chromium (VI), a soluble form of chromium. This chromium (VI) is subsequently removed from the system by the reactor clean-up system by ion exchange columns. In some BWR metallic surfaces, a chromium-rich band has been detected situated close to the base metal where oxygenated coolant does not reach. Up to 20% of the radionuclide concentration in th film is contained in the chromium-rich layer and, it is essential that this band is removed to obtain high decontamination factors. Hence, treatment of the cooling system with an oxidizing agent is applicable to both types of light water cooled reactors and may also be applicable to corrosion product film in other water cooled reactors such as for example, in pressurized heavy water reactors (PHWR) of the CANDU type (Trademark).

CANDU-type heavy water cooled reactors have significant portions of the plant built with chromium bearing alloys. Steam generators of Inconel 600 and pressure tube liners of stainless steel type 410 both contain approximately 15% chromium in the metal. The reducing conditions in the coolant will lead to chromium-rich oxide deposits on metal surfaces.

The radioactive nature of the corrosion products in a nuclear reactor makes them difficult to dispose of once removed from the metal surfaces. Thus, it is important that any process for dissolving and removing the corrosion films require the addition of only small amounts of reagent and yield the removed radioactive corrosion products in a concentrated form, preferably in solid form. In this way the quantity of radioactive waste is kept at a minimum and energy consuming concentration of dilute solutions can be avoided.

Furthermore, it is important that any reagent used in the dissolving and removal of the corrosion products must not be excessively corrosive to the piping systems for which it is used.

Numerous methods for removal of oxide films from the internal surfaces of piping systems, in particular of reactor cooling systems, have been suggested. However, only very few of these methods are effective in removing oxide films containing a high proportion of chromium.

A popular method for removing chromium (III) oxides containing corrosion products comprises a two-step treatment.

The first step involves the use of hot, highly alkaline potassium permanganate. Typical concentrations are 4 percent (weight/volume) potassium permanganate and 10 percent (weight/volume) sodium or potassium hydroxide at 80° to 120° C. This treatment is effective in oxidizing the chromium (III) oxides present in the layer to soluble chromium (VI). Once the chromium is removed, the remaining iron and nickel oxide can be removed by any one of a number of acidic decontamination treatments.

There are several disadvantages to the use of this alkaline potassium permanganate method. These include:

(a) the reactor piping system may require draining prior to application of the alkaline potassium permanganate solution;

(b) large quantities of chemicals are required which, during the oxidation and decontamination process either react or become contaminated with radionuclides, thus requiring concentration prior to disposal;

(c) the system must be flushed with several volumes of fresh water before the second stage, thus producing more waste;

(d) the reagent is highly corrosive to some alloys such as, for example, to Stellite (Trademark).

The present invention comprises a method of treating chromium-containing corrosion products found on internal metal surfaces such as nuclear reactor cooling systems and the like, with a dilute solution of an iron (VI) salt, also referred to as ferrate (VI), to render the chromium compounds contained in the corrosion films more soluble and, thus, also more susceptible to the action of conventional cleaning and decontaminating agents such as the reagent described in Canadian Pat. No. 1,062,590 to Hatcher et al. The treatment involves the oxidation of chromium (III) compounds contained in these corrosion product deposits with a dilute aqueous solution of a ferrate (VI).

The nature of such corrosion products depends (a) on the materials the piping is made of, (b) the conditions inside the piping including flow medium, pH, temperature, radiation, etc., and (c) the years of operation of the piping system. In many nuclear reactors the piping system is made of chromium-containing steel. It follows that the radioactive corrosion films present on all internal surfaces of reactors of this kind, particularly when they have been operated at temperatures between about 100° and 500° C., contain among other metal oxides chromium (III) oxides. Such corrosion films are particularly rich in chromium (III) compounds, when the chemical conditions within the piping system are reducing. Since chromium (III) oxides are substantially isoluble in conventional cleaning and decontaminating agents, they cannot be removed by known decontamination processes such as the one described in the abovementioned Hatcher Patent.

Hatcher's process will in the following be referred to as the CAN-DECON (Trademark) process. The process involves addition of an acidic reagent to the coolant circulating in a contaminated nuclear reactor piping system. The resulting dilute reagent solution solubilizes most corrosion products deposited on the internal surfaces of the piping system, in particular, the precipitated salts and oxides of iron. In order to remove the dissolved cations including radionuclides the reagent solution is passed through a cationic exchange resin and the regenerated reagent solution is recycled as often as necessary. When the decontamination process is completed the reagent solution is passed through a mixed bed ion exchange resin to remove the reagent from the coolant, thus regenerating the coolant. Typically, sufficient reagent is added to the coolant to make up 0.1% (weight/volume) and the resulting reagent solution is circulated at 120° C. for 6 to 24 hours. Under these conditions chromium (III) compounds contained in the deposits of corrosion products are practically insoluble. In order to remove chromium-containing deposits an oxidizing treatment is required to convert chromium (III) to more soluble chromates.

The treatment of the chromium-containing corrosion products according to the present invention with ferrates (VI) as oxidizing agents has several advantages over known oxidizing processes. Ferrates (VI) are strong oxidizing agents and dilute solutions of ferrates were found to oxidize chromium (III) to chromium (VI) in basic or neutral medium, whereby the ferrate is reduced mainly to iron (III). The ferrates can be added directly to an aqueous fluid normally circulating through a piping system such as, for example, the coolant in the heat transfer system of a nuclear reactor. Since according to the invention the products formed in the oxidation process and any unreacted ferrate may be removed from the fluid by passing the fluid through ion exchange resins and, if necessary, filter means, the fluid can be regenerated in situ. In this way the steps of draining the fluid, replacing the fluid with an oxidizing solution and flushing the piping system after the oxidation and solubilization have taken place can be avoided. As a consequence the shut-down time of the system can be reduced.

This is particularly important in the case of nuclear reactors. Pretreatment of the reactor piping system according to the invention requires shutting down of the reactor and depressurizing and cooling down of the coolant. However, it does not require removal of the reactor fuel and replacement of the coolant with an oxidizing solution. Accordingly, the present process not only reduces the period during which the reactor has to be shut-down, but also reduces the volume of radioactive waste products, since neither radioactive oxidizing and cleaning solutions nor washing solutions have to be coped with. All dissolved deposits and the associated radioactivity are retained on resins and on filters.

According to one aspect of the invention there is provided a method of oxidizing chromium containing corrosion products deposited on internal surfaces of a piping system through which an aqueous fluid is circulating. The method comprises adding to the circulating fluid a ferrate (VI) salt to form a dilute ferrate solution while maintaining a pH of between 7 and 14. The ferrate reacts with chromium compounds contained in the corrosion products. The dilute ferrate solution may be circulated until the concentration of chromium salts in the solution approaches a stable value. The fluid may be purified by passing the dilute ferrate solution through ion exchange and filter means.

According to a second aspect of the invention there is provided a method of decontaminating a nuclear reactor piping system through which an aqueous coolant is circulating. The method comprises adding an acidic cleaning reagent to the circulating coolant to form a dilute reagent solution, circulating the reagent solution to react with deposits of corrosion products on internal surfaces of the piping system, regenerating the reagent solution by removal of corrosion products, recycling the regenerated reagent solution, and, subsequently removing said cleaning reagent from the coolant. The improvement according to this invention comprises a process of pretreating the deposits of corrosion products in the piping system with ferrate (VI) salts prior to the addition of an acidic cleaning reagent. The pretreatment process includes adding to the circulating coolant a ferrate (VI) salt to form a dilute ferrate solution while maintaining a pH of between 7 and 14, and continuing circulation of the dilute ferrate solution to oxidize chromium compounds contained in the corrosion product deposits.

Ferrates are added to the circulating fluid at a temperature of about 80° C. or less, preferably of between about 15° and 80° C. and more preferably of about 45° to 60° C. The fluid is adjusted to a pH of between 7 and 14, preferably of between about 9 and 10 and most preferably of about 10. In the acidic pH range and at higher temperatures the suitable ferrates may decompose according to the formula $2FeO_42- + 10H+ \rightarrow 2Fe^{3+} + 3/2O_2 + 5H_2O$.

The ferrate concentration in the fluid should be at least about 0.01% (weight/volume) calculated as $FeO_4^{2-}$, the preferred range is between about 0.01 and 0.5%, the more preferred range is between 0.05 and 0.2% and the most preferred concentration is about 0.1%. The ferrate containing fluid is generally circulated until the rate of solubilization of chromium compounds approaches zero. This may take from about 10 minutes to about 10 hours. Under preferred conditions a period of between about 3 and 6 hours is usually adequate. Additional amounts of ferrate and/or acid or alkali may be required from time to time during the reaction to maintain both the desired ferrate concentration and the pH.

Suitable for this oxidation treatment are ferrate (VI) salts which are soluble in the aqueous fluid. Examples of preferred ferrates are sodium and potassium ferrates as well as other alkali metal ferrates and alkaline metal ferrates. Most preferred is potassium ferrate ($K_2FeO_4$).

The circulating fluid may further contain compounds which tend to enhance the stability of ferrates, such as certain carbonates and phosphates, and/or compounds which enhance the reaction between the ferrates and the oxide deposits.

The products formed in the oxidation process according to the invention, mainly ferric oxide and chromates, as well as unreacted ferrates can, as previously mentioned, be removed by passing the fluid through filtering and ion exchange means, thus regenerating the coolant. If desired, unreacted ferrate may be converted to iron (III) oxide by heating or by the addition of acid. The fact that only small amounts of ferrate have to be added to the fluid facilitates regeneration of the fluid, reduces the amount of radioactive solids formed and, at the same time, lowers the cost of the process.

After regeneration of the fluid further decontamination steps may be performed such as the CAN-DECON process.

Alternatively, a decontamination agent such as the reagent used in the CAN-DECON process may be added directly to the spent ferrate solution containing the oxidation products. The CAN-DECON reagent reacts with the corrosion product film in the reactor piping system, dissolves any salts and oxides which precipitated during the oxidizing pretreatment and decomposes excess ferrate. Cation exchange resins may be used to remove the solubilized iron salt etc. and anion exchange resins or mixed bed ion exchange resins may be used to remove all other contaminants including the reagent itself, thereby regenerating the fluid.

Using this preferred combination of processes, no liquid wastes are produced, but instead all the dissolved deposits and any associated radioactivity are retained on the ion exchange columns leaving the piping surfaces, pump, and valve components, the core itself, and also the coolant in a clean condition. The ion exchange wastes can be handled by conventional procedures as known to those skilled in the art.

It is possible to achieve decontamination factors of greater than 100 using the ferrate process according to the invention in combination with the CAN-DECON step, although in most cases the decontamination factors are in the range of between about 5 and 25.

The effectiveness of all decontamination treatments depends on the composition of the corrosion film. The proportion of chromium in the oxide film, for example, varies widely according to operating conditions, materials, and years of operation of the piping system.

Visual examination as well as measurements of the corrosion rate of the surfaces treated with ferrates according to the invention indicated that corrosion due to treatment with ferrates is very low.

According to a preferred embodiment of the invention the deposits of radioactive chromium-containing corrosion products on the internal surfaces of a PWR, the heat transport system of which is made of stainless steel and Inconel 600, may be removed by shutting down the reactor, depressurizing it and cooling it to about 60° C. With the primary recirculation pumps running a concentrated solution of potassium ferrate is added via a chemical injection pump directly to the primary coolant until a reagent concentration of about 0.1% $FeO_4^{2-}$ (weight/volume) is reached. The pH of the dilute aqueous solution can be maintained constant at about pH10. Additional reagent, acid or alkali are added as required from time to time to maintain both the ferrate concentration and the pH.

After a period of up to 10 hours during which the chromium concentration in the coolant is checked periodically, the amount of solubilized chromium generally reaches a plateau, i.e. the rate of chromium removal from the corrosion film approaches zero. The most effective decontamination is generally achieved when the preferred $FeO_4^{2-}$ concentration is maintained throughout the treatment.

The coolant may first be passed through a filter to remove any particulate matter such as iron (III) oxides and then through a mixed bed ion exchange resin to remove chromates, unreacted ferrate etc. In this way the coolant can be regenerated and the piping system can directly be subjected to further cleaning processes such as the CAN-DECON treatment. Neither flushing of the system nor replacement of the coolant are required.

From the foregoing description, it will be appreciated that the present invention provides a simple and fast oxidizing pre-treatment for the decontamination of piping systems, particularly of nuclear reactor heat transfer systems.

The present invention is further illustrated by way of the following experimental results. It should be noted that the examples are given only for explanation and should not be taken as limiting the present invention.

EXAMPLE 1

CAN-DECON TREATMENT

Sample sections were removed from the piping of the primary cooling systems of two operating BWRs and three operating PWRs. The samples from the BWRs, designated BWR(A) and BWR(B), were stainless steel type 304 pipe sections and the samples from the PWRs, designated PWR(C), PWR(D) and PWR(E) were sections of Inconel 600 steam generator tubing. The corrosion deposit in specimens BWR(A) were a typical example of a substantially chromium-free oxide film whereas the corrosion deposit in specimens BWR(B) contained a chromium-rich band next to the base metal.

The corrosion deposits on all the PWR specimens contained high amounts of chromium. PWR(C) specimens were obtained from a nuclear plant constructed by Combustion Engineering Inc., and PWR(D) and (E) specimens were obtained from nuclear reactors built by Westinghouse. The major difference between the two types of specimens was the relative thickness of the oxide films and the radioactivity associated with these films. PWR(D) and (E) specimens were more radioactive and had a generally thicker, more tenacious corrosion film than PWR(C) specimens, reflecting differences in the length of time the respective reactors had been in operation as well as possible slight differences in the chemistry conditions maintained in the reactors during this period.

The sample sections of the piping were exposed to various decontamination treatments in a test loop. The loop was made of stainless steel piping and contained about 10 liters of deionized water a circulating fluid. The loop was provided with a pump which circulated the water and dissolved reagent within the closed loop. The test facility was designed to reproduce quite closely the flow rate, pressure, temperature, pH, and conductivity that is present in a fullsized reactor during decontamination treatment.

The radioactivity of the sample sections was measured by placing the samples 10 to 20 cm from an intrinsic germanium gamma counter. The signal from the counter was analyzed by a Canberra Series 8 (Trademark) nuclear analyzer, then processed by a PD-11 (Trademark) computer. The computer was programmed to give the activity of the appropriate isotopes in microcuries.

After the radioactivity of the samples had been determined, four types of specimens were treated according to the CAN-DECON process. In each case, LND-101 (Trademark) was used as the acidic agent. LND-101 contains about 40% ethylenediaminetetraacetic acid, 30% oxalic acid and 30% citric acid. The acidic agent was added to the water until a concentration of 0.1% was reached. For the PWR(C) and (D) specimens, the temperature was maintained at 120° C. and the treatment was continued for 6 hours. The BWR(A) specimen in Table I was maintained at a temperature of 125° C. for 6 hours and the BWR(B) specimen in Table I was maintained at 135° C. for 24 hours. The fluid was passed through the cation exchange resin Amberlite IR-120 (H+) (Trademark) during the six-hour period. Thereafter the reagent was removed using Amberlite IRN-150 (Trademark) as a mixed bed ion exchange resin. The final radioactivity was measured, and the decontamination factors were determined. The results are shown in Table I.

It can be seen that treatment with an acidic reagent according to the CAN-DECON process decontaminates the samples of BWR material much more effectively than the samples of PWR material. Specimen (A) shows the highest decontamination factor. The decontamination factor of speciment (B) is lower, mostly due to the fact that this sample contained a chromium-rich band. The decontamination factors obtained for the two different samples of PWR material were very low.

These results demonstrate that the CAN-DECON reagent alone does not to any considerable extent remove chromium (III)-rich films produced under the reducing conditions in the cooling system of most PWRs, and that the CAN-DECON process is, therefore, by far not as effective in decontaminating PWR materials as it is in removing corrosion films from BWR materials.

TABLE I

COMPARISON OF THE EFFECT OF THE CAN-DECON TREATMENT ON PWR AND BWR MATERIALS

| Treatment | Material | Temp (°C.) | Time (h) | Initial Activity (μCi) | Final Activity (μCi) | DF* |
|---|---|---|---|---|---|---|
| 0.1% CAN-DECON | BWR (A) | 125 | 6 | 6.23 | 0.3 | 20.8 |
| 0.1% CAN-DECON | BWR (B) | 135 | 24 | 90 | 11.0 | 8 |
| 0.1% CAN-DECON | PWR (C) | 120 | 6 | 0.55 | 0.43 | 1.3 |
| | | | | 0.57 | 0.48 | 1.2 |
| 0.1% CAN-DECON | PWR (D) | 120 | 6 | 12.6 | 11.8 | 1.1 |

*Decontamination factor

EXAMPLE 2

COMPARISON BETWEEN FERRATE AND PERMANGANATE PRETREATMENT

To determine the effectiveness of an oxidizing pretreatment in removing chromium-rich PWR corrosion deposits, it is necessary to include a second stage treatment capable of dissolving the oxides of iron and associated radionuclides. The CAN-DECON process can be used for this purpose. As can be seen from Table I, when used without any pretreatment, the CAN-DECON reagent and most other non-oxidizing reagents are ineffective in removing chromium-rich corrosion films such as the deposits produced in PWR cooling systems. It follows that any improvement in the decontamination factor of piping which has been subjected not only to the CAN-DECON treatment, but also to an oxidizing pretreatment was directly attributable to the oxidizing pretreatment. Tables II and III show the effect of oxidizing pretreatments on samples from PWRs. The radioactivity of samples from two different PWRs designated PWR(C) specimens and PWR(D) specimens (see Example 1), was determined. Following that, the samples were subjected to pretreatment with ferrate according to the present invention (Process A) or with alkaline permanganate as described by J. A. Ayres in "Decontamination of Nuclear Reactors and Equipment", New York: The Ronald Press Co., 1970 (Process B).

In Processes A and B the samples were placed either in a test loop through which fluid was circulated (see Example 1) or in a glass beaker provided with a stirrer to agitate the fluid. Deionized water was used as fluid.

In process A the fluid was maintained for each sample at the temperature shown in columns 3 of Tables II and III. $K_2FeO_4$ was added to the fluid until a final reagent concentration in weight/volume of 0.01% (Samples 1 and 2 in Table II) or 0.1% (Samples 3 to 5 in Table II and 1 to 4 in Table III) was reached. The pH of the dilute aqueous solution was maintained constant at pH 10. Additional acid or alkali were added as required from time to time to maintain the pH. The ferrate concentration was not maintained and decreased with time. After the period of time indicated in columns 4 of Tables II and III, the fluid was either passed through an Amberlite IRN-150 mixed bed ion exchange resin to remove chromates, unreacted ferrate, etc., or, for convenience, the loop or beaker was drained and refilled with water.

In process B the fluid was heated to a temperature of 100° C. Potassium permanganate and sodium hydroxide were added until a potassium permanganate concentration of 3% (weight/volume) and a sodium hydroxide concentration of 10% (weight/volume) were reached. After the period of time indicated in columns 4 of Tables II and III, the loop was drained, flushed and filled with fresh water.

To the fresh fluid (Process B) or the regenerated fluid (Process A) CAN-DECON reagent was added and the PWR samples were treated according to the CAN-DECON process described in Example 1 at 120° C. for 6 hours. For the CAN-DECON treatment all sample sections were placed in a test loop.

The final activity of each sample was measured and the decontamination factors were determined.

In the case of Sample 4 of Table III, after the CAN-DECON process was completed, the purified fluid was allowed to cool down to about 60° C. and Process A was repeated followed by a second CAN-DECON treatment.

Samples 6 and 7 in Table III were not pretreated. Sample 6 was treated once according to the CAN-DECON process and Sample 7 was subjected twice to the CAN-DECON process.

As may be seen from Table II in the case of PWR (C) material, which had a relatively low radioactivity, both the samples pretreated with ferrate and the samples pretreated with permanganate show large improvements in their decontamination factors when compared with the decontamination factor of speciment PWR(C) in Table I. Even Sample 2 which was pretreated with a very dilute ferrate solution shows a greatly increased decontamination factor. These results show that the ferrate pretreatment is very effective particularly considering that only very low concentrations (0.01 to 0.1%) and relatively low temperatures (60° C.) are required. By contrast, the permanganate pretreatment calls for a 13% solution and a temperature of 100° C.

As may be seen from Table III PWR(D) material exhibited a much higher initial activity. When compared with Samples 6 and 7 and the PWR(D) specimen in Table I, Samples 1 to 5 exhibit improved decontamination factors. The overall decontamination factors for PWR(D) specimens is lower than for PWR(C) specimens. This may be due to the fact that the corrosion deposits on PWR(D) specimens is thicker than on PWR(C) specimens. The oxidizing reagents dissolve chromium deposit in the surface layer, but cannot dissolve the iron oxides. These are removed in the CAN-DECON process. Hence, the effectiveness of the oxidizing treatment is limited to the first few micrometers of the corrosion film. As a consequence, it is advantageous to subject thick corrosion films to two successive ferrate/CAN-DECON treatments. In the first ferrate/-CAN-DECON treatment, the surface layers of the corrosion film are oxidized and removed making the remaining film susceptible to further oxidation in the second ferrate pretreatment step and further oxide removal in the second CAN-DECON treatment. This is illustrated by Samples 2 and 4. Both samples were treated under identical conditions except that Sample 4 was subjected to a second ferrate/CAN-DECON treatment. The resulting decontamination factor of Sample 4 was about 50% higher than the decontamination factor of Sample 2.

TABLE II

COMPARISON OF THE EFFECT OF OXIDATION PRETREATMENTS ON PWR(C) MATERIAL

| Sample | Pretreatment | Temp (°C.) | Time (h) | Initial Activity (μCi) | Final Activity* (μCi) | DF+ |
|---|---|---|---|---|---|---|
| 1 | 0.01% ferrate | 25 | 17 | 0.44 | 0.3 | 1.5 |
| | | | | 0.53 | 0.32 | 1.7 |
| 2 | 0.01% ferrate | 50 | 6 | 0.47 | 0.06 | 7.8 |
| | | | | 0.35 | 0.025 | 14.0 |
| 3 | 0.1% ferrate | 25 | 6 | 0.34 | 0.032 | 10.6 |
| | | | | 0.55 | 0.035 | 15.7 |
| 4 | 0.1% ferrate | 45 | 6 | 0.30 | 0.025 | 12 |
| | | | | 0.26 | 0.023 | 11 |
| 5 | 0.1% ferrate, | 60 | 6 | 0.25 | 0.014 | 18 |
| | | | | 0.26 | 0.016 | 16 |
| 6 | 3% permanganate + 10% (w/v) NaOH | 100 | 6 | 0.41 | 0.0 | ∞ |
| | | | | 0.50 | 0.009 | 56 |

*Final activity measured after pretreatment followed by a standard CAN-DECON treatment (0.1% reagent, 120° C., 6h).
+ Decontamination Factor

TABLE III

COMPARISON OF THE EFFECT OF OXIDATION PRETREATMENTS ON PWR(D) MATERIAL

| Sample | Pretreatment | Temp. (°C.) | Time (h) | Initial Activity (μCi) | Final Activity (μCi) | DF+ |
|---|---|---|---|---|---|---|
| 1 | 0.1% ferrate | 25 | 6 | 13.1 | 10.0* | 1.3 |
| | | | | 12.3 | 9.0* | 1.4 |
| 2 | 0.1% ferrate | 60 | 6 | 14.0 | 6.2* | 2.3 |
| | | | | 12.0 | 5.3* | 2.3 |
| 3 | 0.1% ferrate | 75 | 6 | 10.8 | 6.2* | 1.7 |
| | | | | 11.4 | 6.3* | 1.8 |
| 4 | 0.1% ferrate (treated twice) | 60 | 6 | 14.0 | 4.5* | 3.1 |
| | | | | 12.0 | 3.7* | 3.2 |
| 5 | 3% permanganate + 10% (w/v) NaOH | 100 | 4 | 14.3 | 2.0* | 7.2 |
| | | | | 12.9 | 1.8* | 7.2 |
| 6 | None (one CAN-DECON treatment) | | | 14.5 | 14.0 | 1.0 |
| 7 | None (two CAN-DECON treatments) | | | 14.5 | 12.9 | 1.1 |

*Final activity measured after pretreatment followed by a standard CAN-DECON treatment (0.1% reagent, 120° C., 6h)
+ Decontamination factor.

Tables II and III clearly show that pretreatment of samples of PWR material with dilute ferrate solutions significantly improves the decontamination factors when compared with the decontamination factors obtainable by treatment according to the CAN-DECON process alone. Furthermore, the results show the remarkable effectiveness of the ferrate treatment when compared with the much more concentrated alkaline permanganate treatment.

Due to its high concentration the alkaline permanganate is much more difficult to remove from the fluid than the ferrate. Thus, in order to follow the alkaline permanganate treatment with a cleaning process such as the CAN-DECON process the fluid has to be passed through large amounts of ion exchange resin (about 100 times the amount required for the removal of ferrate) or alternatively, the system has to be drained and flushed, producing large amounts of radioactive waste.

EXAMPLE 3

DETERMINATION OF CORROSION RATES

Specimens of Inconel 600 and stainless steel type 304 (304SS) were weighed and subjected to one of the following treatments:

(1) a CAN-DECON treatment according to Example 1 under conditions of 0.3% reagent, 135° I C., 24h;

(2) a ferrate treatment according to process A of Example 2 under conditions of 0.1% ferrate, 60° C., 6h, followed by a CAN-DECON treatment as in (1);

(3) an alkaline permanganate treatment according to process B of Example 2 under conditions of 4% potassium permanganate, 10% NaOH, 100° C., 6h, followed by a CAN-DECON treatment as in (1).

After the treatment scale was removed and the specimens were weighed again, the loss of weight per hour of treatment and per surface area was determined and the corrosion rate in μm per hour was calculated. The results shown in Table IV are averages of four samples.

TABLE IV

COMPARISON OF CORROSION RATES

| | Corrosion rate (μm/h) | | |
|---|---|---|---|
| Material | CAN-DECON (1) | ferrate and CAN-DECON (2) | permanganate and CAN-DECON (3) |
| 304SS | .14 | .13 | .10 |
| Inconel 600 | .06 | .05 | .04 |

From the results in Table IV it can be seen that the corrosion rates of both the 304SS and Inconel 600 samples are practically identical whether the samples were pretreated with ferrate or not. It follows that the small amount of corrosion which occurs is due entirely to the CAN-DECON treatment.

EXAMPLE 4

COMPARISON OF THE FERRATE PRETREATMENT AT CONSTANT FERRATE CONCENTRATION AND THE PERMANGANATE PRETREATMENT.

In Example 2 the pretreatment of PWR specimens with ferrate according to process A included the addition of potassium ferrate to the circulating fluid, typically in an amount sufficient to reach a starting $FeO_4^{2-}$ concentration of 0.1% (weight/volume). In this process the effective ferrate concentration after 1 to 2 hours is considerably lower than the starting concentration. This is mainly due to oxidation reactions and decomposition of the reagent.

In the following series of experiments, the results of which are shown in Table V, fresh reagent was added as required so as to maintain the desired ferrate concentration throughout the ferrate treatment.

The radioactivity of samples from a PWR, designated PWR(E) specimens (see Example 1), was determined. Following that, the samples were subjected to pretreatment with ferrate according to the present invention or with alkaline permanganate as described by J. A. Ayres (see Example 2).

The samples were placed in a test loop through which fluid was circulated as described in Example 1.

For the ferrate pretreatment the fluid was maintained for each sample at the temperature shown in column 3 of Table V. $K_2FeO_4$ was added to the fluid until a final reagent concentration in weight/volume of 0.1% (Samples 2, 3, and 4) or 0.5% (Sample 5) was reached. The pH of the dilute aqueous solution was maintained constant at pH 10. Additional acid or alkali were added as required from time to time to maintain the pH and additional ferrate was added to maintain the desired ferrate concentration. After the period of time indicated in column 4 of Table V, the fluid was either passed through a mixed bed ion exchange resin or, for convenience, the loop was drained and refilled with water. For the permanganate pretreatment the fluid was heated to a temperature of 100° C. Potassium permanganate and sodium hydroxide were added until a potassium permanganate concentration of 4% (weight/volume) and a sodium hydoxide concentration of 10% (weight/volume) were reached. After 3 hours the loop was drained, flushed and filled with fresh water.

To the fresh or regenerated fluid CAN-DECON reagent was added until a concentration of 0.3% was reached and the PWR(E) samples were treated according to the CAN-DECON process described in Example 1 at 135° C. for 24 hours.

The final activity of each sample was measured and the decontamination factors were determined.

The corrosion rates were determined in the same way as in Example 3.

Sample 6 was not pretreated prior to being subjected to the CAN-DECON process.

The values for initial activity, final activity and corrosion rate as shown in Table V are the average of two samples.

TABLE V

COMPARISON OF THE EFFECT OF FERRATE PRETREATMENT AT CONSTANT FERRATE CONCENTRATION AND PERMANGANATE PRETREATMENT ON PWR(E) MATERIAL

| Sample | Treatment | Temp. (°C.) | Time (h) | Initial Activity (μCi) | Final Activity* (μCi) | DF** | Corrosion Rate (μm/h) |
|---|---|---|---|---|---|---|---|
| 1 | 4% permanganate + 10% NaOH | 100 | 3 | 7.14 | 0.1 | 71.4 | 0.04 |
| 2 | 0.1% ferrate | 45 | 6 | 9.44 | 0.3 | 31.4 | 0.04 |
| 3 | 0.1% ferrate | 45 | 12 | 8.45 | 0.1 | 84.5 | 0.07 |
| 4 | 0.1% ferrate | 60 | 6 | 11.6 | 0.35 | 33.1 | 0.05 |
| 5 | 0.5% ferrate | 45 | 6 | 7.81 | 0.6 | 13.0 | 0.07 |
| 6 | None | — | — | 9.18 | 7.48 | 1.2 | 0.05<br>0.07 (304SS) |

*Final activity measured after pretreatment followed by a CAN-DECON treatment (0.3% reagent, 135° C., 24h)

**Decontamination Factor.

Table V shows that pretreatment with dilute ferrate solutions at a substantially constant ferrate concentration very effectively decontaminates the radioactive PWR(E) samples. The ferrate pretreatment in conjunction with the CAN-DECON treatment resulted in a reduction of radioactivity on the samples of between about 95 and 99% (Samples 2 to 4). The reduction in radioactivity due to the CAN-DECON treatment was less than 20% (Sample 6). Treatment of the PWR(E) material at a ferrate concentration of 0.5% did not improve the decontamination factor (Sample 5), but tended to be slightly less efficient than treatment at lower ferrate concentrations. The concentrated alkaline permanganate pretreatment in conjunction with the CAN-DECON treatment resulted in a reduction of radioactivity on the sample of about 99 to 99.5% (Sample 1). Thus, pretreatment of PWR(E) material with a ferrate solution which was maintained at a concentration of 0.1% for 6 hours at 45° C. is substantially as effective as treatment with 4% permanganate in 10% sodium hydroxide for 3 hours at 100° C.

As can be seen from column 8 Table V, the ferrate pretreatment has no substantial effect on the total rate of corrosion of the PWR(E) material. The small amount of corrosion which occurs is due to the CAN-DECON treatment of the samples.

We claim:

1. A method of oxidizing chromium-containing corrosion products deposited on internal surfaces of a piping system through which an aqueous fluid is circulating, said method comprising adding to said circulating fluid ferrate (VI) salts to form a dilute ferrate solution, for reaction with chromium compounds contained in said corrosion products while maintaining a pH of between 7 and 14 and continuing to circulate said dilute ferrate solution, while maintaining an effective ferrate concentration in said solution, until the concentration of chromium in said solution approaches a stable value.

2. A method as in claim 1 wherein the temperature of the dilute ferrate solution is maintained at or below about 80° C., wherein the dilute ferrate solution has a $FeO_4^{2-}$ concentration of at least 0.01% (weight/volume), and wherein the ferrate is selected from water-soluble ferrate (VI) salts.

3. A method as in claim 1 or 2 wherein the dilute ferrate solution further includes stabilizing compounds.

4. A method as in claim 1 or 2 wherein said dilute ferrate solution has an $FeO_4^{2-}$ concentration of between 0.01 and 0.5% (weight/volume).

5. A method as in claim 1 or 2 wherein the pH is maintained at between about 9 and 10.

6. A method as in claim 1 or 2 wherein the temperature of the dilute ferrate solution is maintained at between about 45° and 60° C.

7. A method as in claim 1 or 2 wherein the dilute ferrate solution has a $FeO_4^{2-}$ concentration of between 0.05 and 0.2% (weight/volume).

8. A method as in claim 1 or 2 wherein the ferrate is selected from the group consisting of sodium and potassium ferrates.

9. A method as in claim 1 or 2 wherein said dilute solution has a $FeO_4^{2-}$ concentration of about 0.1% (weight/volume).

10. A method as in claim 1 or 2 wherein the ferrate is potassium ferrate.

11. A method as in claim 1 wherein said dilute ferrate solution is continually circulated until the rate of chromium removal from said deposited corrosion products approaches zero.

12. A method as in claim 1 or 2 wherein said dilute ferrate solution is circulated for a period of between about 10 minutes and 10 hours.

13. A method of oxidizing chromium(III) components contained in corrosion products deposited on internal surfaces of a nuclear reactor piping system through which a coolant is circulating, said method comprising:

(a) adding to the circulating coolant water-soluble ferrate(VI) salts to form a dilute ferrate solution having a $FeO_4^{2-}$ concentration of at least about 0.01% (weight/volume) while maintaining the pH of the dilute ferrate solution at between 7 and 14 and the temperature at or below about 80° C.; and (b) continuing to circulate said dilute ferrate solution to oxidize the chromium (III) compounds contained in said corrosion products with said ferrate until the rate of chromium removal from said deposited corrosion products approaches zero.

14. A method as in claim 13 further comprising the step of regenerating said coolant in situ by passing said coolant through ion exchange and filter means to remove particulate and dissolved oxidation products and unreacted ferrate.

15. A method as in claim 13 or 14 wherein the ferrate is selected from the group consisting of sodium and potassium ferrates, the dilute ferrate solution has a $FeO_4^{2-}$ concentration of between about 0.01 and 0.5%, the pH is maintained at between about 9 and 10 and the temperature at between about 15° and 80° C.

16. A method as in claim 13 or 14 wherein the ferrate is potassium ferrate, the dilute ferrate solution is maintained at a $FeO_4^{2-}$ concentration of about 0.1%, and the temperature is maintained at between about 45° and 60° C.

17. A method as in claim 13 or 14 wherein the dilute ferrate solution further includes compounds enhancing the stability of ferrates.

18. In a method of decontaminating a nuclear reactor piping system which has chromium-containing corrosion product deposits on its internal surfaces through which an aqueous coolant is circulating, which method comprises adding an acidic cleaning reagent to the circulating coolant to form a dilute reagent solution; circulating said reagent solution to react with the deposits of corrosion products on the internal surfaces of said piping system; regenerating said reagent solution by removal of corrosion products therefrom; recycling the regenerated reagent solution; and, subsequently removing said cleaning reagent from the coolant; the improvement comprising a process of pretreating the deposits of corrosion products in the piping system with ferrate (VI) salts prior to the addition of the acidic cleaning reagent, said pretreatment process including adding to the circulating coolant a ferrate (VI) salt to form a dilute ferrate solution while maintaining a pH of between 7 and 14; and continuing circulation of said dilute ferrate solution to oxidize chromium compounds contained in said corrosion product deposits.

19. A method as in claim 18 further comprising the step of regenerating said coolant while circulating in said piping system prior to adding the acidic cleaning reagent to the coolant.

20. A method as in claim 19 wherein circulation of said dilute ferrate solution is continued until the rate of chromium removal from said deposited corrosion products approaches zero.

21. A method as in claim 18, 19, or 20 wherein the temperature of the dilute ferrate solution is maintained at or below about 80° C.

22. A method as in claim 18, 19, or 20 wherein the dilute ferrate solution has a $FeO_4^{2-}$ concentration of at least 0.01% (weight/volume).

23. A method as in claim 18 wherein the temperature of the dilute ferrate solution is maintained at between about 15° and 80° C.

24. A method as in claim 23 wherein the dilute ferrate solution has a $FeO_4^{2-}$ concentration of between about 0.01 and 0.5% (weight/volume).

25. A method as in claim 20 or 24 wherein the ferrate is selected from the group consisting of sodium and potassium ferrates.

26. A method as in claim 18, 19, or 20 wherein circulation of said dilute ferrate solution is continued for a period of between about 10 minutes and 12 hours.

27. A method as in claim 19, 20, or 24 wherein regenerating of said coolant includes passing the dilute ferrate solution through a mixed bed ion exchange resin system to remove corrosion products.

28. In a method of decontaminating a nuclear reactor piping system which has chromium-containing corrosion product deposits on its internal surfaces and through which an aqueous coolant is circulating, which method comprises adding an acidic cleaning reagent to the circulating coolant to form a dilute reagent solution; circulating said reagent solution to react with the deposits of corrosion products on the internal surfaces of said piping system; passing said reagent solution through a cationic exchange resin to remove dissolved corrosion products and regenerate the reagent solution; recycling the regenerated reagent solution; and, subsequently, passing the reagent solution through a mixed bed ion exchange resin system to remove said cleaning reagent from the coolant; the improvement comprising a process of pretreating the deposits of corrosion products in the piping system with a ferrate(VI) salt prior to the addition of the acidic cleaning reagent, said pretreatment process including adding to the circulating coolant potassium ferrate to form and maintain a dilute ferrate solution having a $FeO_4^{2-}$ concentration of about 0.1% (weight/volume) while maintaining a pH of between about 9 and 10 and a temperature of between about 45° and 60° C., continuing circulation of the dilute ferrate solution to oxidize the chromium compounds contained in said corrosion product deposits until the rate of solubilization of the chromium compounds approaches zero; and subsequently, passing the circulating solution through an ion exchange resin system to regenerate the coolant.

29. A method as in claim 18, 19 or 28 wherein the dilute ferrate solution further includes stabilizing compounds.

30. The method of claim 1, further comprising regenerating said aqueous fluid in situ by passing said fluid through ion exchange and filter means.

* * * * *